US006239717B1

(12) United States Patent
Weissbrod et al.

(10) Patent No.: US 6,239,717 B1
(45) Date of Patent: May 29, 2001

(54) ON DELAY DEVICE FOR A VISUAL DISPLAY UNIT

(75) Inventors: Holger Weissbrod, Paderborn; Heiner Drewer-Gutland, Delbrück; Heinrich Hehemann, Melle, all of (DE)

(73) Assignee: Wincor Nixdorf GmbH & Co. KG, Paderborn (DE)

( * ) Notice: Subject to any disclaimer, the term of this patent is extended or adjusted under 35 U.S.C. 154(b) by 0 days.

(21) Appl. No.: 09/554,824

(22) PCT Filed: Nov. 3, 1998

(86) PCT No.: PCT/DE98/03202

§ 371 Date: May 19, 2000

§ 102(e) Date: May 19, 2000

(87) PCT Pub. No.: WO99/27516

PCT Pub. Date: Jun. 3, 1999

(30) Foreign Application Priority Data

Nov. 20, 1997 (DE) ..... 197 51 577

(51) Int. Cl.[7] ..... G08B 5/00

(52) U.S. Cl. ..... 340/815.4; 340/10.6

(58) Field of Search ..... 340/815.4, 10.52, 340/10.6; 395/750; 713/324, 330; 345/211–213, 117

(56) References Cited

U.S. PATENT DOCUMENTS

| | | | | |
|---|---|---|---|---|
| 5,375,245 | * | 12/1994 | Solhjell et al. | 395/750 |
| 5,414,863 | * | 5/1995 | Lee et al. | 395/750 |
| 5,648,799 | * | 7/1997 | Kikinis | 345/212 |
| 5,801,635 | | 9/1998 | Price | 340/656 |

FOREIGN PATENT DOCUMENTS

| | | |
|---|---|---|
| 94 09 987 | 9/1994 | (DE) . |
| 197 29 823 | 1/1998 | (DE) . |
| 0 487 742 A1 | 6/1992 | (EP) . |
| 0 678 843 A2 | 10/1995 | (EP) . |
| WO92/11624 | 7/1992 | (WO) . |
| WO93/15495 | 8/1993 | (WO) . |

* cited by examiner

*Primary Examiner*—Jeffery Hofsass
*Assistant Examiner*—Son M. Tang
(74) *Attorney, Agent, or Firm*—McCormick, Paulding & Huber LLP

(57) ABSTRACT

The invention describes a turn-on delay device (10) for a visual display unit (14) which can be placed into an idle state by disabling at least one signal (H-SYNC IN, V-SYNC IN) controlling the visual display unit (14). The turn-on delay device contains, amongst other things, a disabling device (42, 44, 46) which disables the signal (H-SYNC IN, V-SYNC IN) for a predetermined delay period. When the delay period has elapsed, the signal (H-SYNC IN, V-SYNC IN) is supplied to the visual display unit (14).

11 Claims, 2 Drawing Sheets

ON DELAY DEVICE FOR A VISUAL DISPLAY UNIT

FIELD OF THE INVENTION

The invention relates to a turn-on delay device for a visual display unit.

In many areas of public life, for example in the services sector, computer systems are today used which allow a user to perform transactions automatically without having to rely on external assistance. An example of this is cash dispensing machines at banks, which can be used by a customer of the bank to withdraw money from his account even outside business hours. Such computer systems usually contain a central computer to which an input device and a visual display unit, i.e. a monitor, as an output device, are connected. The user uses the input device to supply the necessary input information to the computer system. The input device used can be a keyboard or a so-called touchscreen, for example. A touchscreen is understood as being an input device which is integrated into the screen of the visual display unit and converts touches from the user into input information.

The visual display units used today are generally monitors operating on the basis of the so-called VGA standard, which condition an analog signal containing textual and graphics information and display the corresponding images on their screen. The analog signal is produced in the computer by a control device which is tuned to the visual display unit used. A control device tuned to a VGA monitor is also called a VGA graphics card.

A computer system operated in the manner just described needs, like any other computer system, to be restarted from time to time when it has been turned off for maintenance work, for example, or when its voltage supply has been interrupted for other reasons. When the computer is started, i.e. when an operating system is loaded into the computer's main memory, system messages are generally displayed on the screen of the visual display unit. No entries must be made using the input device in this phase, since an error causing the computer system to fail completely will otherwise be produced in the computer system. Such system failure is also called a "system crash".

Cash dispensing machines now frequently encounter the problem that a user misinterprets the system messages displayed on the screen of the visual display unit and makes entries in the computer system's starting phase, for example by touching the touchscreen, which causes the system crash just described. Such a system failure generally needs to be put right by a technician, which means that the cash dispensing machine is out of service for a relatively long time.

A known solution to the problem just described is to turn off the voltage supply of the visual display unit in the starting phase of the computer system, with the result that the system messages do not appear on the screen in this phase and the user does not feel encouraged to actuate the input device. If a touchscreen is used as the input device, this solution is not practical, however, since the touchscreen and the input controller driving it, which is also called a touch controller, is supplied with voltage by the voltage supply for the visual display unit. When the visual display unit is turned off, communication between the computer's operating system and the input controller is thus interrupted, which means that the input controller, and hence the touchscreen, are not operational when the visual display unit has been turned on.

SUMMARY OF THE INVENTION

EP-A0 678 843 discloses a method of deactivating a visual display unit in which the visual display unit can be placed into the idle state by disabling at least one signal controlling said visual display unit, the signal produced by a control device being disabled for a predetermined delay period.

The object of the invention is to specify a device which can minimize the risk of a user who is misguided by the computer system's system messages causing the computer system to fail.

The invention achieves this object with a turn-on delay device for a visual display unit which can be placed in an idle state by disabling at least one signal controlling the visual display unit. The turn-on delay device contains at least one input which is connected to a control device supplying the signal to it, a disabling device which disables the signal for a predetermined delay time, and at least one output which is connected to the visual display unit and supplies the signal to the latter when the delay time has elapsed.

Modern visual display units generally have a so-called energy-saving function which ensures that the visual display units go blank if one or more control signals are absent. Functioning as control signals are usually a horizontal sync signal and a vertical sync signal, which are produced by a control device in a computer, e.g. a graphics card, and coordinate the movement of an electron beam in the visual display unit's picture tube, with the horizontal sync signal controlling the horizontal flyback and the vertical signal controlling the vertical flyback of the electron beam as the screen is set up. It is now a provision of the invention that, connected between the computer's control device and the visual display unit, there is a turn-on delay device which blocks the control signals for a predetermined delay time when the computer is started, so that the screen of the visual display unit is blank while the operating system is loaded, and the system messages which are otherwise displayed on the screen are not displayed. In this way, it is possible to minimize the risk of a user standing in front of the visual display unit feeling prompted by the system messages displayed on the screen to make entries using an input device, for example a keyboard or a touchscreen, and thus causing the computer system to fail completely.

The invention makes it possible to add further equipment to an existing computer system in the manner shown above irrespective of the operating system and of the software used, without needing to make any considerable changes to the computer system. The invention can, in particular, be applied to all computer systems in which a control device operating on the basis of the VGA standard, i.e. a VGA graphics card, drives a VGA monitor. The connection between the turn-on delay device and the computer, on the one hand, and between the turn-on delay device and the visual display unit, on the other hand, can be made using standard connections, such as D-subminiature plug-ins connections and corresponding connector receptacles. In one advantageous development of the invention, the disabling device contains at least two switches, of which a first switch connects a first input, to which the control device supplies a horizontal sync signal, to a first output, and a second switch connects a second input, to which the control device supplies a vertical sync signal, to a second output. The mutually associated inputs and outputs are accordingly connected to one another directly via a respective switch driven by the disabling device. Advantageously, the switches can be in the form of CMOS switches. Advantages of the switches produced in CMOS technology are low susceptibility to interference, low space requirement and high temperature stability.

The disabling device can also contain a timing circuit which turns on the first and the second switch when the delay time has elapsed. Inexpensive integrated circuits can be used as the timing circuit.

The timing circuit is particularly simple to produce using a monostable multivibrator. When the computer system is started, the sync signals supplied to the delay device can switch (as an example) an output, driving the switches, of the multivibrator to its unstable state. In this state, the output of the multivibrator causes the switches to be off and thus causes the sync signals to be disabled. When the delay time has elapsed, the output of the multivibrator automatically reverts to its stable state and turns on the switches. The sync signals are now available to the visual display unit for setting up the screen. The delay time can advantageously be set using a potentiometer.

If a voltage supply fed by the horizontal sync signal is provided in the turn-on delay device, then there is no need for an external voltage supply or for a voltage supply in the form of a battery. This reduces production and operating costs and makes it easier for existing computer systems with the turn-on delay device to have additional equipment fitted.

To reduce the space requirement of the turn-on delay device, it can be produced using surface mount technology, also called SMD technology.

According to a further aspect of the invention, a method of deactivating a visual display unit is specified.

Further advantageous developments of the invention are dealt with in the subclaims and in the description which follows:

BRIEF DESCRIPTION OF THE DRAWINGS

The invention is explained in more detail below with the aid of the figures, in which.

DETAILED DESCRIPTION OF THE PREFERRED EMBODIMENT

Figure 1:
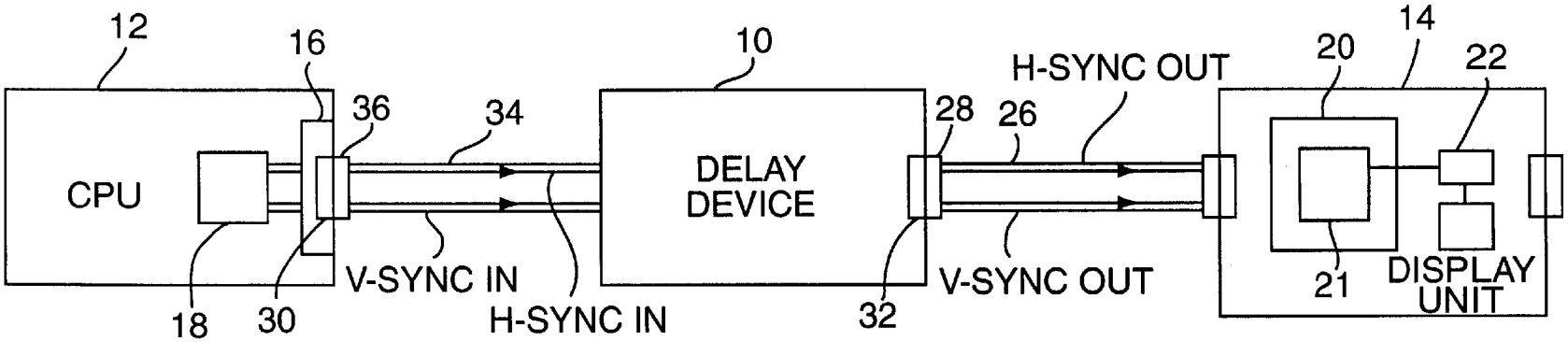
FIG. 1 shows a schematic illustration of a system comprising a computer, a turn-on delay device and a visual display unit.

The basic way in which the invention works is illustrated in FIG. 1, which shows a turn-on delay device 10 connecting a computer 12 to a visual display unit 14. The components shown in FIG. 1 can be part of a system used in a bank, for example, to allow a customer of the bank to perform cash transfers or account debits automatically.

The design of the computer 12 and of the visual display unit 14 and the way in which they work are known per se, so that the description of these components can be kept brief at this point.

The computer 12 can be a personal computer of known type having an interface 16 for connecting the visual display unit 14. The computer 12 also contains a controller 18, for example in the form of a plug-in graphics card, which conditions the textual and graphics information processed in the computer for the visual display unit 14. In the illustrative embodiment to be explained, the controller 18 is a VGA graphics card which converts the textual and graphics information into an analog signal and supplies it to the visual display unit 14, which, for its part, operates on the basis of the VGA standard.

The visual display unit 14 contains a screen 20 having an integrated input device 21, also called a touchscreen, which a customer of the bank can use to make entries by touching the screen 20. The visual display unit 14 also has an input controller 22, i.e. a touch controller, for driving the touchscreen, and a voltage supply 22.

In known systems, a connecting cable 26 coming from the visual display unit 14 is connected directly to the interface 16 of the computer 12. The connection between the connecting cable 26 and the interface 16 is usually made using a standardized plug-in connection. Thus, for example, the connecting cable 26 is provided with a conventional 15-pin D-subminiature connector 28 which, in a system based on the prior art, is plugged into a corresponding connector receptacle 30 on the interface 16 of the computer 12.

The system shown in FIG. 1 is distinguished from the prior art by the turn-on delay device 10, which is connected between the computer 12 and the visual display unit 14. On the turn-on delay device 10, there is a connector receptacle 32 which matches the D-subminiature connector 28 on the connecting cable 26 and can be identical to the connector receptacle 30 on the interface 16 of the computer 12. The D-subminiature connector 28 on the connecting cable 26 is plugged into the connector receptacle 32 on the turn-on delay device 10. In place of the connecting cable 26 from the visual display unit 14, a connecting cable 34 is connected to the connector receptacle 30 on the interface 16 using a D-subminiature connector 36. The connecting cable 34 can be permanently attached to a housing of the turn-on delay device 10.

The VGA graphics card 18 produces a plurality of control signals which are necessary for showing an image in the visual display unit 14 and of which FIG. 1 shows only a horizontal sync signal H-SYNC IN and a vertical sync signal V-SYNC IN. The sync signals H-SYNC IN, V-SYNC IN are supplied via the connecting cable 34 to the turn-on delay device 10, are disabled there (as is yet to be described) for a predetermined delay time in the starting phase of the computer, and are switched through to the visual display unit 14 when this delay time has elapsed. In FIG. 1, the switched-through sync signals are called H-SYNC OUT and V-SYNC OUT. The sync signals H-SYNC OUT and V-SYNC OUT coordinate the movement of an electron beam in a picture tube (not shown in FIG. 1) in the visual display unit 14.

The visual display unit 14 has an energy-saving function as provided nowadays in VGA monitors. If the visual display unit 14 registers the absence of the sync signals H-SYNC OUT and V-SYNC OUT, it is placed in an idle state, where, by way of example, its screen 20 goes blank. The technical precautions necessary for this purpose on the visual display unit 14 are known per se and are therefore not explained further at this point. The essential thing is that the visual display unit 14 reacts, in the manner just described, to the absence of the sync signals H-SYNC OUT and V-SYNC OUT.

Figure 2:
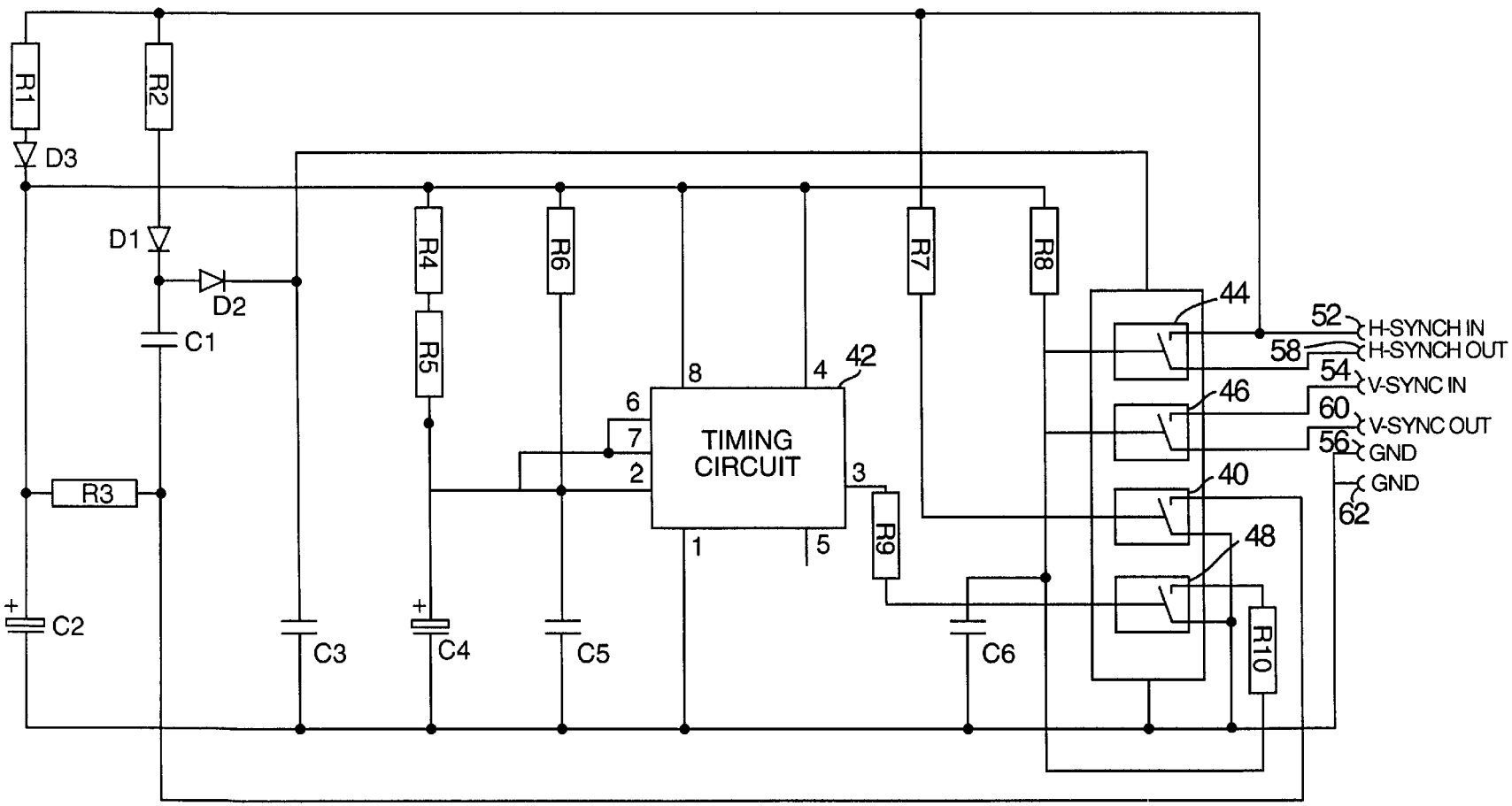
FIG. 2 shows a circuit arrangement for the turn-on delay device shown in FIG. 1.

FIG. 2 shows a possible circuit arrangement for the turn-on delay device 10, which switches through the sync signals H-SYNC IN and V-SYNC IN produced by the controller 18 to the visual display unit 14 when a settable disabled time has elapsed after the computer 12 has been turned on or restarted. The circuit arrangement shown in FIG. 2 contains a functional unit which builds up the voltage supply for the turn-on delay device 10 in a manner which is yet to be described. This functional unit comprises the resistors R1, R2, R3, R7, the diodes D1, D2, D3, the capacitors C1, C2, C3, and the switch 40. A timing circuit 42 forms a further functional unit with the resistors R4, R6, the potentiometer R5 and the capacitors C4 and C5. In the illustrative embodiment being explained, the timing circuit 42 is an ICM7555IBA-type integrated circuit, operated as a monostable multivibrator. The other components shown in FIG. 2 and connected to the timing circuit 42 are the resistors R8, R9, R10, the capacitor C6 and the switches 44, 46 and 48. These components can also be essentially regarded as a functional unit.

The switch 40 and further switches 44, 46, 48 are combined in a quad switch 50. The quad switch 50 is produced in CMOS technology and is in the form of an HEF4066BT-type integrated circuit. The circuit arrangement shown in FIG. 2 also contains inputs 52, 54, 56 and outputs 58, 60, 62. The inputs 52, 54, 56 are to be allocated to the connector receptacle 30 and the outputs 58, 60, 62 are to be allocated to the D-subminiature connector 28 shown in FIG. 1.

The sync signals H-SYNC IN, V-SYNC IN produced by the VGA graphics card 18 are supplied to the turn-on delay device 10 via the inputs 52 and 54, respectively. The input 56 and the output 62 of the turn-on delay device 10 are grounded (GND).

The way in which the circuit arrangement shown in FIG. 2 works is explained below. In the phase in which the graphics card 18 is still not producing any sync signals H-SYNC IN and V-SYNC IN, there is no signal present at the inputs 52 and 54 of the turn-on delay device 10. The switches 44, 46 of the integrated circuit 50 are off at this instant. When the sync signals H-SYNC IN and V-SYNC IN appear at the inputs 52, 54, the voltage supply is built up in the turn-on delay device 10 by utilizing the energy supplied to the turn-on delay device 10 in the form of the sync signal H-SYNC IN. For this purpose, the sync signal H-SYNC IN is supplied to the functional unit mentioned initially, which comprises resistors R1, R2, R3, the diodes D1, D2, D3 and the capacitors C1, C2, C3, as well as the switch 40 with the resistor R7 connected upstream of it. The resistors R1, R2, R3, R7 are used for current limiting, and the diodes D1, D2 and D3 produce smoothed DC voltages from the sync signal H-SYNC IN, which is an AC voltage signal, in combination with the capacitors C1, C2, C3. If the voltage at an input 64 of the switch 40 reaches a predetermined value, the switch 40 turns on, and the voltage supply is built up. Since the voltage required for operating the turn-on delay device 10 is provided by the sync signals H-SYNC IN and V-SYNC IN, there is no need for an external voltage supply or for a voltage supply in the form of a battery.

When the voltage supply has been produced in the turn-on delay device 10 in the manner just described, the timing circuit 42 operated as a monostable multivibrator is started via an input 2 which has an RC combination comprising the resistor R6 and the capacitor C5 connected upstream of it. At this moment, an output 3 of the timing circuit 42 is changed to an unstable state, which continues for a predetermined delay time. In this phase, the duration of which is defined by the resistor R4, the capacitor C4 and the potentiometer R5, the switches 44, 46 remain off. When the delay time has elapsed, the output 3 of the timing circuit 42 reverts to a stable state and turns on the switches 44, 46 in the integrated circuit 50 via the resistors R8, R9, R10, the capacitor C6 and the switch 48. The sync signals H-SYNC IN and V-SYNC IN are now switched through to the outputs 58 and 60 of the turn-on delay device 10 by the switches 44, 46 and are thus available to the visual display unit 14. The switched-through sync signals are called H-SYNC OUT and V-SYNC OUT in FIG. 2. The setup of the screen can finally be completed in the visual display unit 14 using the sync signals H-SYNC OUT and V-SYNC OUT.

The delay time after which the timing circuit 42 operated as a monostable multivibrator turns on the switches 44, 46 via its output 3 is equivalent to the disabled time, in which the screen 20 of the visual display unit 14 goes blank after the operating system of the computer 10 is started. This delay time can be set at the potentiometer R5, whose resistance value can be set externally using a screwdriver, for example. In the illustrative embodiment shown in FIG. 2, the delay time can be set to a value between 0.5 and 5 minutes.

The invention is not restricted to the circuit arrangement shown in FIG. 2, which should merely be regarded as a specific illustrative embodiment. The dimensional design of the components used in the circuit arrangement shown in FIG. 2 is suited to the sync signals H-SYNC IN and V-SYNC IN as produced by the VGA graphics card 18. For the illustrative embodiment shown in FIG. 2, the components have the following dimensions:

R1=680, R2=1.8 k, R3 22=k, R4=22 k, R5 to 1 M, R6=1 M, R7=100 k, R8=1 M, R=100 k, R10=1.8 k, C1:1 F/16 V, C2:10 F/16 V, C3:1 F/16 V, C4:100 F/10 V, C5:100 nF/50 V, C6:100 nF/50 V.

The capacitors C2 and C4 are electrolytic capacitors having the polarity indicated in FIG. 2. The diodes D1 and D2 used are BAR43S-type diodes and the diode D3 used is a BAR42-type diode.

List of Reference Symbols

10 Turn-on delay device
12 Computer
14 Visual display unit
16 Interface
18 Controller
20, 21 Screen with integrated input device
22 Input controller
24 Voltage supply for the visual display unit
26 Connecting cable
28 D-subminiature connector
30 Connector receptacle
32 Connector receptacle
34 Connecting cable
36 D-subminiature connector
40 Switch
42 Timing circuit
44 Switch
46 Switch
48 Switch
50 Quad switch
52 Input
54 Input
56 Input
58 Output
60 Output
62 Output
R1 to R10 Resistors
C1 to C6 Capacitors
D1, D2, D3 Diodes

What is claimed is:

1. A turn-on delay device (10) for a visual display unit (14) which can be placed in an idle state by disabling at least one signal (H-SYNC IN, V-SYNC IN) controlling the visual display unit (14), said device comprising at least one input (52, 54) which is connected to a control device (18) supplying the signal (H-SYNC IN, V-SYNC IN) to it, a disabling device (42, 44, 46) which disables the signal (H-SYNC IN, V-SYNC IN) for a predetermined delay time, and at least one output (58, 60) which is connected to the visual display unit (14) and supplies the signal to the latter when the delay time (H-SYNC OUT, V-SYNC OUT) has elapsed.

2. The turn-on delay device (10) as claimed in claim 1, wherein the disabling device contains at least two switches (44, 46), of which a first switch (44) connects a first input (52), to which the control device supplies a horizontal sync signal (H-SYNC IN), to a first output (58), and a second switch (46) connects a second input (54), to which the control device supplies a vertical sync signal (V-SYNC IN), to a second output (60).

3. The turn-on delay device (10) as claimed in claim 2, wherein the switches (44, 46) are in the form of CMOS switches.

4. The turn-on delay device (10) as claimed in claim 2, or 3, characterized in that the disabling device contains a timing circuit (42) which turns on the first and the second switch (44, 46) when the delay time has elapsed.

5. The turn-on delay device (10) as claimed in claim 4, wherein the timing circuit (42) is a monostable multivibrator.

6. The turn-on delay device (10) as claimed in claim 4, and further comprising a potentiometer (R5), connected upstream of the timing circuit (42), for setting the delay time.

7. The turn-on delay device (10) as claimed in claim 2, and further comprising a voltage supply fed by the horizontal sync signal (H-SYNC IN).

8. The turn-on delay device (10) as claimed in claim 7, wherein the voltage supply has means (D1 to D3, C1 to C3) for rectifying and smoothing the horizontal sync signal (H-SYNC IN).

9. The turn-on delay device (10) as claimed in claim 1, wherein said device is produced using surface mount technology.

10. The turn-on delay device (10) as claimed in claim 1, wherein said device is for a VGA visual display unit.

11. A method of deactivating a visual display unit (14) which can be placed in an idle state by disabling at least one signal (H-SYNC IN, V-SYNC IN) controlling the visual display unit (14), wherein the signal (H-SYNC IN, V-SYNC IN) produced by a control device (18) is disabled for a predetermined delay period, and the signal (H-SYNC IN, V-SYNC IN) is enabled and supplied to the visual display unit (14) when the delay time has elapsed.

* * * * *